US005746672A

United States Patent [19]

Smith

[11] Patent Number: 5,746,672

[45] Date of Patent: May 5, 1998

[54] TENNIS DOUBLES TRAINING APPARATUS AND METHOD

[76] Inventor: Gwenevere Jane Smith, 852 A Third St., Encinitas, Calif. 92024

[21] Appl. No.: 713,439

[22] Filed: Sep. 13, 1996

[51] Int. Cl.[6] ..... A63B 69/00

[52] U.S. Cl. ..... 473/464

[58] Field of Search ..... 273/453, 464

[56] References Cited

U.S. PATENT DOCUMENTS

| | | | |
|---|---|---|---|
| 2,937,023 | 5/1960 | Seymour | 273/153 |
| 3,458,188 | 7/1969 | Infante | 273/153 |
| 3,480,275 | 11/1969 | Jernstrom et al. | 273/153 |
| 4,621,589 | 11/1986 | Thinnes | 119/96 |
| 4,688,564 | 8/1987 | Kelly | 128/133 |
| 4,765,748 | 8/1988 | Fidalgo | 273/153 |

*Primary Examiner*—Theatrice Brown

*Attorney, Agent, or Firm*—Fulwider Patton Lee & Utecht, LLP

[57] ABSTRACT

An apparatus and method for training doubles tennis team players on the proper relative positions to be maintained during active doubles play. Such apparatus incorporates a tether between the players arranged to disconnect when the force on the tether exceeds a predetermined level.

9 Claims, 1 Drawing Sheet

TENNIS DOUBLES TRAINING APPARATUS AND METHOD

BACKGROUND OF THE INVENTION

1. Field of the Invention

This invention relates to sport training apparatus, and more particularly to a tennis training apparatus for developing tennis doubles team skills as these skills relate to the relative location of team members on the tennis court during play.

2. Description of the Prior Art

The first doubles championship tournament was played at Wimbledon, England in 1879, five years after Major Walter Clopton Wingfield was awarded Letters Patent No. 685, "A Portable Court for Playing Tennis." Generally, doubles tennis was nearly ignored as a spectator sport until the mid 1950's. Beginning then, it rapidly developed into a spectator sport and became a widely enjoyed recreational activity. In recent years, doubles tennis has developed to the point where it is a fast, technical, team sport that is interesting and exciting for the gallery. Doubles tennis has, in fact, become more popular than singles tennis in most tennis clubs around the world. It is no longer thought of as merely four people playing tennis on a larger court. The strategy, team work, concentration and anticipation necessary for winning doubles tennis dictates training quite different from singles tennis. After basic stroke production is perfected, the training disciplines for doubles tennis have little in common with singles tennis training.

An important discipline for team members to master in doubles tennis training is maintaining the optimal relative locations of the players to one another at virtually all times. With the exception of the serve, if one partner is at the net, the other partner should be at the net. Conversely, if one partner is playing the base line, the other partner should be playing the base line. Lateral movement about the court by the team players should be in concert. If one player moves far to the side of the court to cover a possible down-the-line return by an opponent, the team partner should move laterally in the same direction, while maintaining a predetermined distance between the two players. Thus, the relative location, distance apart and relative lateral movements (side-to-side) of the partners on the court are all important. Unless these disciplines have become instinctive with the team players, in the "heat of battle," they are easily forgotten.

To date, no effective teaching aid has been available to aid players on a doubles team in learning to maintain the desired spacing between them on a tennis court. Tethering devices to restrain children have been available. However, there has been no known suggestion of using such devices as a tennis training aids. More importantly, such devices require attachment means to the child that cannot be separated except by a concerted effort by the parent or guardian when the restraining device is no longer required, and they would not be suitable for use in tennis.

What has been needed in the area of tennis doubles training is an apparatus that will remind the partners not to exceed a predetermined distance between each other during play, while at the same time not disrupting their freedom of movement or restrain or lock the partners together in such a manner as to subject them to possible injury if the predetermined distance of their separation is exceeded. This invention provides such apparatus for doubles training.

SUMMARY OF THE INVENTION

Briefly, and in general terms, the present invention provides a tennis doubles training apparatus wherein a tethering device alerts the team partners when they approach or exceed a predetermined distance from one another during practice sessions.

The apparatus comprises an elongated, flexible tether approximately six to ten feet in length, preferably about eight feet. Attached to the opposite ends of the tether are means for detachably connecting the tether to the players. When the tether is connected to the players and the method of the invention is put to use, a "line of communication" is established between the players which will provide a restraining force when the players approach a distance apart that corresponds to the length of the tether. To ensure the players are not thrown off balance, caused to fall down, or otherwise subjected to possible harm due to tension from the tether strap during play, means are provided to disconnect the tether in response to a force on the tether in excess of a predetermined level.

In a more detailed aspect of the invention, disconnect couplings are provided at the opposite ends of the tether. These couplings are configured to break the tethered connection when the force on the tether is in excess of the predetermined level. For convenience of use, the tether connection can then be reestablished.

A further detailed aspect of the invention encompasses a pair of waistband assemblies designed to conveniently attach about the waists of the team players to detachably connect the tether to the players. Each such assembly, in turn, mounts a portion of the disconnect coupling in the operative link between the tether and the players.

These and other features and advantages of the invention will appear in the following detailed description of the preferred embodiment, read in conjunction with the accompanying drawings.

DETAILED DESCRIPTION OF THE PREFERRED EMBODIMENT

Figure 1:
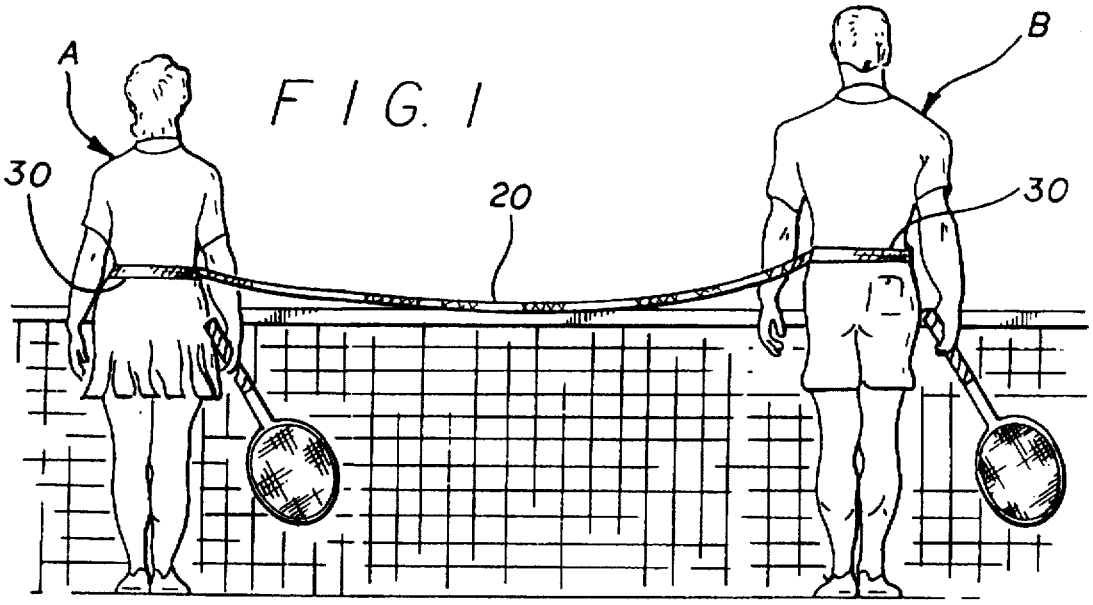
FIG. 1. is a rendering showing doubles players using training apparatus constructed in accordance with the invention.
Figure 2:
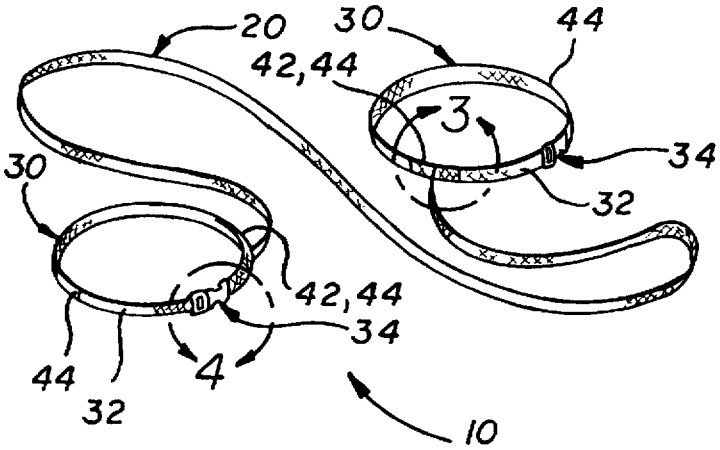
FIG. 2. is a perspective of the apparatus of FIG. 1.
Figure 3:
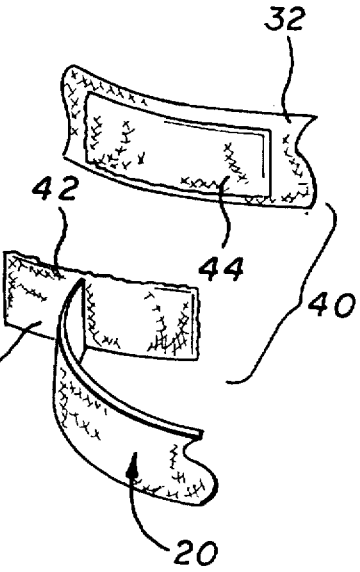
FIG. 3. is an enlarged, exploded view taken in the region of circle 3 in FIG. 2.

Referring to the drawings, and particularly to FIGS. 1 and 2, the invention is shown embodied in training apparatus 10. As shown, apparatus 10 includes generally a tether 20 detachably connected to team members identified as players A and B in FIG. 1 by waistband assemblies 30. In order that apparatus 10 accomplish its intended purpose, yet avoid a condition of excessive force on the tether, a disconnect coupling is provided in the link between the players as shown in FIGS. 2 and 3. Two such couplings are provided in the form of Velcro™ fasteners 40 in the illustrative embodiment. By virtue of tether 20 and the coupling arrangement afforded by waistband assemblies 30 and fasteners 40, players A and B are linked together with the maximum spacing between them under conditions of normal use being dictated by the length of the tether.

It should be appreciated that any convenient device for detachably connecting the tether 20 to the players may be provided. Desirable features, in addition to providing for convenient attachment, are to do so in a manner that minimizes the impact on movement and stroking during play. In the illustrative embodiment, as previously noted and as shown in FIGS. 1 and 2, a pair of waistband assemblies 30 are provided. Each such assembly comprises a flexible belt 32 of sufficient length to comfortably fit around the waist of the associated player. Adjustability of belt length (not shown) is desirable in order to accommodate players of different size.

Figure 4:
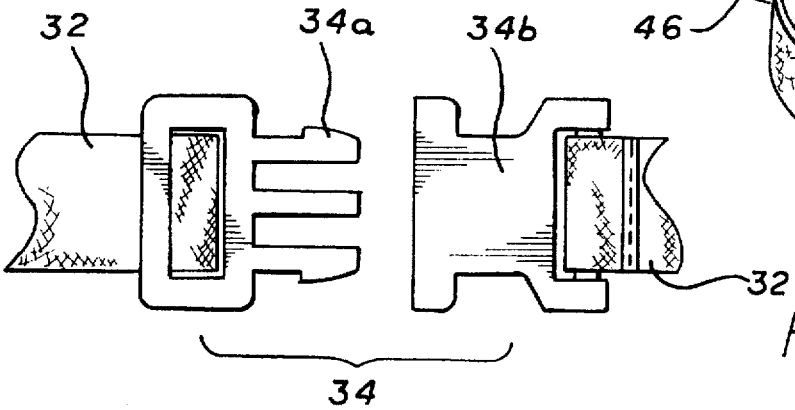
FIG. 4. is an enlarged plan view taken in the region of circle 4 in FIG. 2.

A suitable buckle 34 includes male and female components 34*a* and 34*b*, respectively, as illustrated in detail in FIG. 4.

The tether 20 is shown (FIG. 2) as a elongated flexible strap. Preferably, it is made of a non-stretchable material which is light in weight, yet sufficiently strong to hold up under conditions of sustained use in the intended manner.

Providing for disconnection of the tether connection of the players responsive to force in excess of a predetermined level is achieved by the Velcro™ fasteners 40 shown in detail in FIG. 3. Mating elements 42 and 44 of each fastener are secured to the respective ends of the tether 20 and to the waistbands 30. Attachment of the Velcro™0 elements (e.g., ¾" elements of Catalog No. 90081 material about 2½" in length) may be accomplished by sewing the Velcro™ strips in place. With respect to the element 42 on the tether 20, a pad is provided by folding over an end portion of the tether, as at 46 in FIG. 3, which is then adapted for engagement with the element 44 on the belt 32. To conveniently accommodate reversal of the sides of the court on which players A and B are positioned and to provide for adjustability for player preference, additional Velcro™ elements 44 may be provided at spaced locations (not shown) around the circumference of each waistband assembly 30.

It will be appreciated that varying the sizes of the mating Velcro™ elements 42 and 44, or possibly even the areas of element engagement, the force required to effect disconnection can be established at the desired predetermined level. Players of different size and/or ability may find different force level desirable. As previously noted, the force level should be established sufficiently high to alert players effectively to their relative positions without disconnection, but not so high as to cause either player to lose his or her balance and risk a fall.

In using apparatus 10 to carry out the method of the invention waistband assemblies 30 are positioned comfortably around the waists of the team players A and B. If the tether 20 is not already in place, it is attached by the Velcro™ fasteners 40 to the respective waistbands 30 to link players A and B together.

As players A and B then move about the court during doubles play, they will "feel" the tension of the tether in the event they approach the limit of the spacing it establishes. In the event they exceed such maximum spacing, one or both of the Velcro™ fasteners 40 will separate to disconnect the tether connection, thus enabling the players to move farther apart without undue interference. Re-engagement for subsequent play can be readily accomplished by simply pressing together the mating elements 42 and 44 of the fastener 40 involved.

Experience indicates that doubles team players rarely find themselves out of position in the sense of being too close to one another. On the other hand, frequently players who are not highly skilled or who have not played together to any extent will find themselves too far apart during active play. With apparatus 10, this tendency can be effectively overcome by virtue of the "line of communication" provided by the tether 20 as the players approach the limit of optimal spacing, or exceed it.

While a preferred embodiment of the invention has been illustrated and described, it will be apparent to those skilled in the art that various modifications and changes may be made thereto without departing from the spirit and scope of the invention as defined in the appended claims.

What is claimed is:

1. Tennis training apparatus for aiding in maintaining the desired spacing between players on a doubles team, comprising:

an elongated, flexible tether;

connecting means for attaching said tether at spaced apart locations to the players to connect them to one another via said tether; and disconnect means including at least one Velcro™ fastener associated with said tether and responsive to a force on said tether in excess of a predetermined level to break the tether connection.

2. The apparatus of claim 1, wherein said tether is in the range of about six to ten feet in length.

3. The apparatus of claim 1, wherein said connecting means include a pair of detachable waistband assemblies connected, one each, to the tether at its opposite ends.

4. The apparatus of claim 1, wherein said disconnected means incorporates at least one fastener adapted for reconnection in the event the tether connection is broken.

5. The apparatus of claim 4, wherein said disconnect means further incorporates a pair of said Velcro™ fasteners located at the opposite ends of said tether.

6. Tennis training apparatus for teaching players of doubles tennis to maintain the desired distance between them during doubles play, comprising;

an elongated, flexible tether;

connectors at opposite ends of said tether for securing said tether to the players and establishing a tethered connection between them; and a pair of disconnect couplings located, one each, at the opposite ends of said tether operatively associated with said tether and responsive to the application of a force to said tether in excess of a predetermined level to break the tether connection.

7. A method of teaching tennis players on a doubles team to maintain the desired spacing between one another during active doubles play, comprising the steps of:

establishing a tethered connection between the team players at a distance corresponding generally to the optimal spacing between them during doubles play; and breaking such tethered connection in response to a force applied to the tether in excess of a predetermined level.

8. The method of claim 7, wherein the breaking of said tethered connection occurs when the players exceed said optimal spacing dictated by the length of said tether, thereby exceeding said predetermined level of force applied to said tether.

9. The method of claim 7 further, wherein approaching the full length of the tether connection results in application of a force that alerts the players to the fact that they are about to exceed the optimal spacing between one another.

* * * * *